US006748716B1

(12) United States Patent
Peck, Jr. et al.

(10) Patent No.: US 6,748,716 B1
(45) Date of Patent: Jun. 15, 2004

(54) IMPACT-PROTECTING WALL GUARD

(75) Inventors: Ronald Peck, Jr., Pawling, NY (US); Robert Wayne Disbrow, Dover Plains, NY (US)

(73) Assignee: Pawling Corporation, Pawling, NY (US)

( * ) Notice: Subject to any disclaimer, the term of this patent is extended or adjusted under 35 U.S.C. 154(b) by 0 days.

(21) Appl. No.: 10/407,766

(22) Filed: Apr. 4, 2003

(51) Int. Cl.[7] ..... E04C 2/38

(52) U.S. Cl. ..... 52/718.04; 52/287.1; 52/716.8; 52/717.03; 293/136

(58) Field of Search ..... 52/287.1, 288.1, 52/716.1, 716.8, 718.04, 718.06, 717.03; 293/135, 136; 24/459, 517, 545, 563

(56) References Cited

U.S. PATENT DOCUMENTS

| | | | | | |
|---|---|---|---|---|---|
| 1,325,924 | A | * | 12/1919 | Breuer et al. | 293/135 |
| 1,355,592 | A | * | 10/1920 | De Graw | 293/135 |
| 1,394,238 | A | * | 10/1921 | Verloove | 293/135 |
| 2,243,322 | A | * | 5/1941 | Uum | 24/293 |
| 3,981,118 | A | * | 9/1976 | Johnson et al. | 52/716.8 |
| 4,258,515 | A | * | 3/1981 | Owen | 52/105 |
| 4,430,833 | A | * | 2/1984 | Balzer et al. | 52/255 |
| 4,753,467 | A | * | 6/1988 | DeCaluwe et al. | 293/126 |
| 5,033,244 | A | * | 7/1991 | Ullman | 52/288.1 |
| 5,283,096 | A | * | 2/1994 | Greenberg et al. | 428/67 |
| 5,289,662 | A | * | 3/1994 | Castle | 52/287.1 |
| 5,406,762 | A | * | 4/1995 | Buard | 52/287.1 |
| 5,704,176 | A | * | 1/1998 | Greenberg | 52/300 |
| 6,479,747 | B2 | * | 11/2002 | Bellanger | 174/50 |

OTHER PUBLICATIONS

Pawling 10260/PAW BuyLine 0416 Catalog, "Impact Protection at Every Turn", pp. 12, 13.

* cited by examiner

*Primary Examiner*—Leslie A. Braun
*Assistant Examiner*—Jon Szumny
(74) *Attorney, Agent, or Firm*—Schweitzer Cornman Gross & Bondell LLP

(57) ABSTRACT

A wall mounted bumper guard for protecting walls, especially of institutional buildings, such as hospitals, nursing homes, schools, etc. Molded plastic clips are secured to a wall structure at spaced locations. A resilient cover shell is configured such that its upper and lower edges are engaged and secured by upper and lower ends of said clips. Impact resisting elements are carried by the clips and positioned under central portions of the cover shell. The impact resisting elements are of relatively stiff plastic construction and of an inverted V-shaped configuration. One end of the impact resisting element has a hinged engagement with the clip, and the other end is slidable on the clip. The central portion of the impact resisting element engages and supports central portions of the cover shell to resist excessive inward deflection thereof resulting from impact. Aligning and positioning tabs on the clip bodies assist in accurate mounting of the clips on a wall structure and accurate mounting and positioning of end caps and corner caps. In a modified version, the V-shaped impact resisting elements may be replaced by a continuous resilient strip, which is mounted on a plurality of clips and extends over substantially the full length of the cover shell.

9 Claims, 5 Drawing Sheets

IMPACT-PROTECTING WALL GUARD

BACKGROUND OF THE INVENTION

Many office buildings and institutional structures, such as hospitals, nursing homes, schools, and the like, install impact-protecting wall guards along corridor walls, to protect against accidental impact from wheeled carts, wheelchairs and the like. A common form of such wall guard includes a retainer element, typically an aluminum extrusion, which is mounted on the wall to be protected, at an appropriate level. A cover shell, typically of extruded "rigid" plastic, is designed to be snapped over the previously installed retainer and provides a resilient impact cushion to protect the wall structure. Frequently, particularly for wider sizes of wall guards, one or more resilient strips are mounted on the retainer, underlying the cover shell, to provide additional support against impact deflection of the center portion of the plastic shell. The present invention improves upon existing designs of wall guards of this general type.

SUMMARY OF INVENTION

For some applications, it is not necessary that the retainer be a continuous extrusion. It is acceptable, in many cases, that relatively short retainer sections be fixed to the wall, spaced apart a predetermined distance, such as sixteen inches. Typically, such retainer sections are formed by extruding a continuous length of retainer cross section, cutting individual short sections from the continuous length, and drilling or otherwise machining those short, cut-off sections to provide means for mounting them on a wall structure. Pursuant to the invention, a novel and improved form of attachment clip is provided, for securing impact-resisting wall guards to wall structures in a more convenient and economical manner. The attachment clip is formed by injection molding techniques, rather than cutting of an extruded section. This enables a number of important features to be incorporated into the attachment clip to improve its functioning and also to facilitate and expedite installation of the wall guard on the wall structure to be protected.

In a preferred form of the invention, the attachment clip includes a novel form of impact-resisting spring element which is rotatably or flexibly attached at one end to the body of the clip, and slidably supported at its other end on the body of the clip. Portions of the impact-resisting element between the ends thereof project outward and serve as an impact-resisting support for a plastic cover shell attached to the surface of a wall by means of the clips.

Pursuant to one aspect of the invention, the molded clip body is formed with a hinge socket, preferably in the form of a partial cylinder of slightly more than 180 degrees. This hinge socket is offset toward one end of the clip body, and its open side faces toward the opposite end. A resilient impact-resisting element is formed with a cylindrical bead on at least one end thereof, which has a snap-fit with the cylindrical hinge socket. When the bead is snapped in place into the hinge socket, the impact-resisting element is retained against other than intentional removal. The impact-resisting element spans the center portion of the clip body, and is configured so its center portion is offset outward from the clip body so as to closely underlie a plastic cover shell mounted by means of the clip. Advantageously, the free end of the impact-resisting element is positioned over a support surface provided by the clip base, such that the free end is supported for limited sliding movement when the element is deflected inwardly under impact forces.

To facilitate accurate mounting of the clips, the molded clip bodies advantageously are provided with reference pointers, preferably in the center thereof, which can be accurately aligned with a chalk line, for example, enabling an installer to quickly install a plurality of the mounting clips along the surface of a wall structure while maintaining a high level of alignment accuracy.

In accordance with another aspect of the invention, the molded clip bodies are provided with spaced-apart pairs of locating tabs projecting from each side thereof. These are used to great advantage to facilitate accurate location and mounting of end caps that are installed to close the open ends of the extruded cover shell. Careful positioning of these ends caps is important to providing a neat overall appearance to the installation, and the provision of the locating tabs reliably assures efficient and accurate positioning of such end caps.

In a preferred embodiment of the invention, a rigid support rib underlies the center portion of the impact-resisting element. In the case of excessive impact forces, this element can serve as a distortion limit for the impact-resisting element. Additionally, this element provides means for mounting of a continuous resilient cushioning element, running the entire length of the plastic cover shell. The cushioning element, in such cases, normally would be used in place of the previously described impact-resisting spring element otherwise provided on each clip. In the alternative arrangement, the resilient cushion is mounted on a plurality of the clip bodies and spans the space between such clip bodies to provide a form of continuous cushioning along the entire length of the cover shell.

For a more complete understanding of the above and other features and advantages of the invention, reference should be made to the following detailed description of preferred embodiments thereof, and to the accompanying drawings.

DESCRIPTION OF PREFERRED EMBODIMENTS OF THE INVENTION

Figure 1:
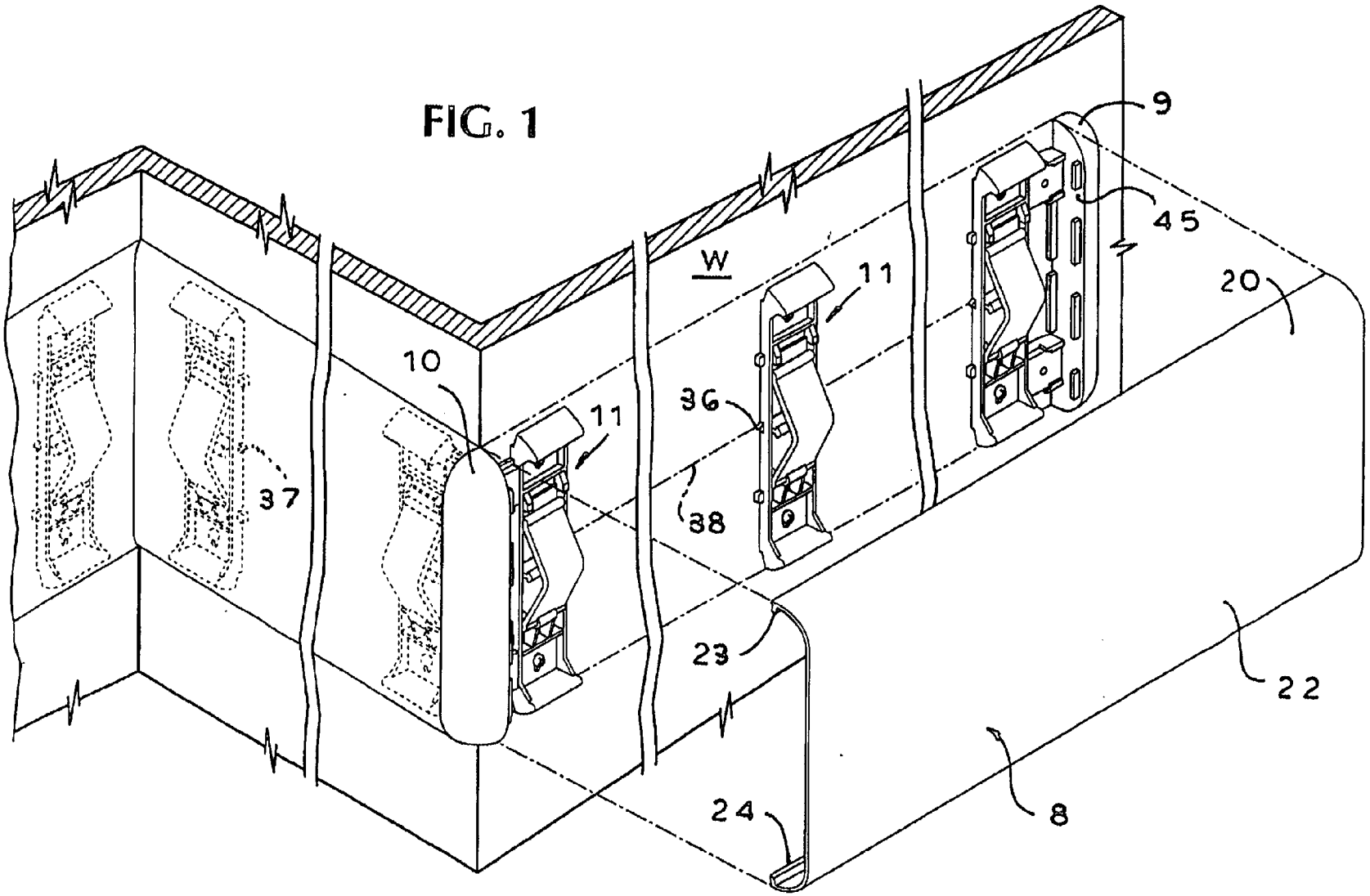
FIG. 1 is an exploded, perspective view illustrating a wall guard installation constructed in accordance with the principles of the invention.

Referring now to the drawings, and initially to FIGS. 1–4 thereof, the reference character W designates generally a wall structure to be protected by a wall guard. In a construction according to the invention, a plurality of mounting clips 11, spaced apart a predetermined distance such as sixteen inches, are secured to the surface of the wall structure in a horizontal alignment. As will be described in more detail hereinafter, a plastic cover shell 8, typically formed by extrusion in any suitable length, is secured to the wall structure W by the plurality of mounting clips 11, located at a suitable level to provide protection against bumps and scrapes from dolleys, wheelchairs and the like. The open ends of the cover shell are closed by suitable caps. In the illustrated arrangement, an end cap 9 is attached at the right hand side of the cover shell, and a corner cap 10 is provided at the opposite end, where the wall structure W forms an external corner.

Figure 3:
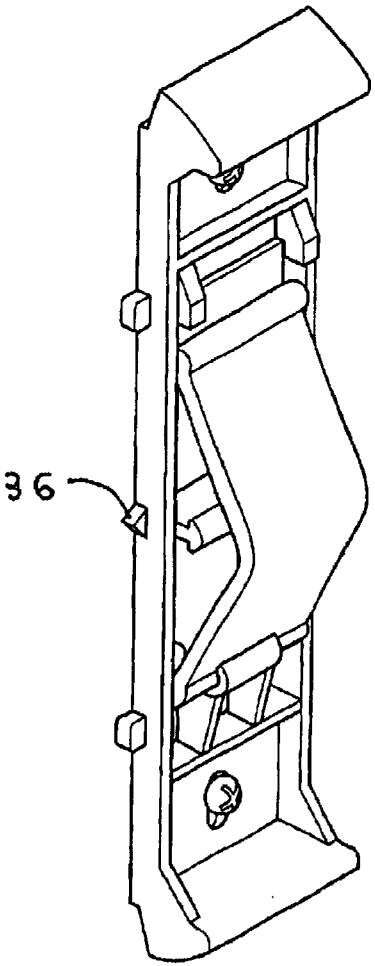
FIG. 3 is a perspective view of the device of FIG. 2, shown in a fully assembled condition.
Figure 2:
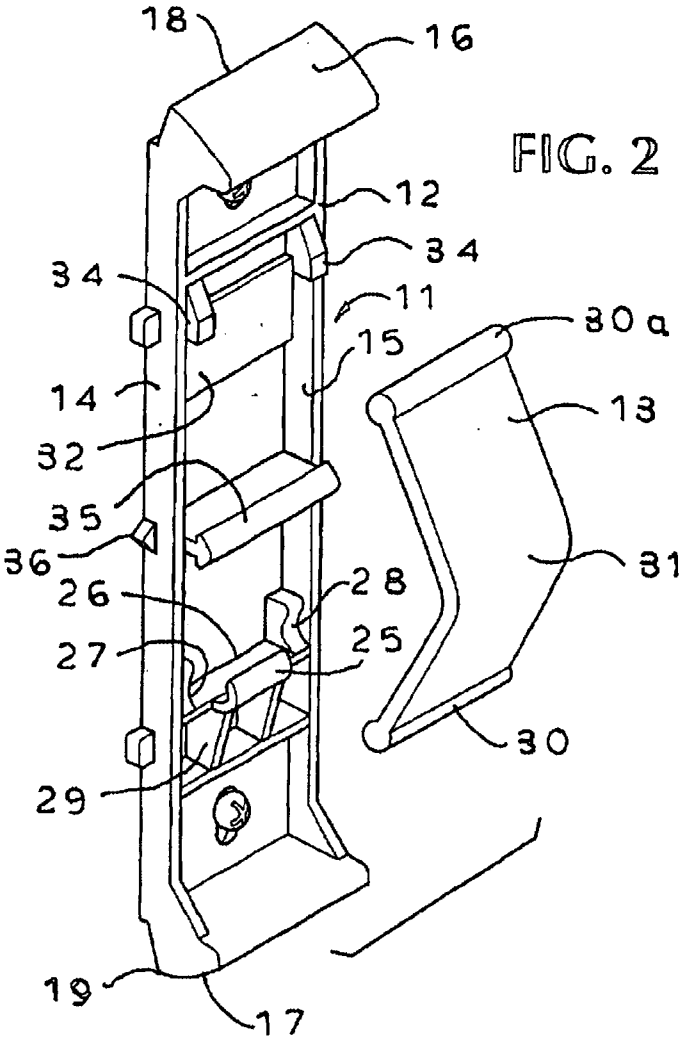
FIG. 2 is an exploded, perspective view illustrating a novel form of clip body and impact-resisting spring element according to the invention.
Figure 4:
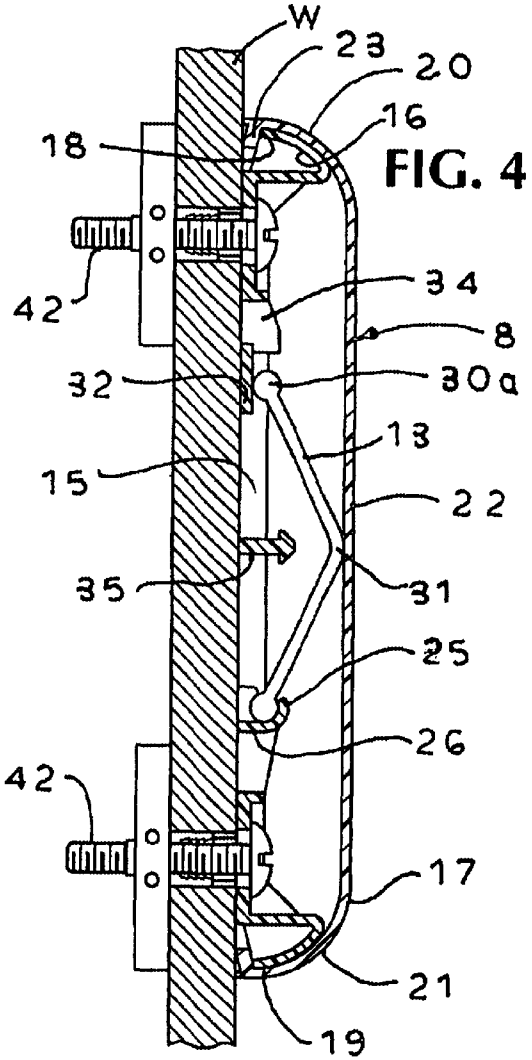
FIG. 4 is a cross sectional view of an installation as shown in FIG. 1, with the section being taken centrally through a clip body.

With reference to. FIGS. 2–4, the clip elements 11 are comprised of a clip body 12 and a separate impact-resisting spring element 13. Pursuant to the invention, the clip body 12 is an injection molded item, formed of a structural plastic material. The clip body comprises a pair of spaced-apart side walls 14, 15 which extend vertically in the properly oriented clip body. At each end of the clip body and extending from one side wall to the other thereof, are arcuate caming and support surfaces 16, 17. In the illustrated arrangement, the bottom edges of the side walls 14, 15 define a flat plane, and are adapted to be seated flat against the surface of the wall W (see FIG. 4). The innermost edges 18, 19 of the arcuate cam surfaces 16, 17 terminate in spaced relation to that plane.

As shown in FIG. 4, the extruded plastic cover shell 8 has upper and lower edge portions 20, 21 of arcuate contour, and a central panel portion 22, which typically is flat and, when installed, extends parallel to the surface of the wall structure W. At each edge extremity of the cover shell is an inwardly directed locking flange 23, 24 arranged to lockingly engage behind the edge extremities 18, 19 of the arcuate surfaces 16, 17. This arrangement enables the cover shell 8 to be pressed forcibly over the ends 16, 17 of the clip body 11, with the cam surfaces 16, 17 serving to distort the opposite edge portions of the cover shell sufficiently to enable the locking flanges 23, 24 to slide over the surfaces of the cams and snap inwardly behind the edge extremities 18, 19, into installed, locked-in-place positions as shown in FIG. 4. Desirably, the curvature of the cam surfaces 16, 17 substantially matches the internal contours of the cover edge portions 20, 21, such that the opposite ends of the clip body provide support for the upper and lower edges of the cover shell 8.

In accordance with one aspect of the invention, the clip body 11 is molded to form a first arcuate hinge part 25, which is offset to one side of the center of the clip body and extends outward and somewhat toward the center of the body from a transverse wall 26. The transverse wall extends from one side wall to the other, while the arcuate hinge part 25 extends over a lesser portion, approximately one half the width of the clip body, located generally in the center thereof. Second hinge parts 27, 28, forming integral parts of the body molding, are positioned on opposite sides of the first or upper hinge part 25. The second or lower hinge parts 27, 28 are formed with upwardly facing hinge seats of arcuate contour. As reflected in FIG. 4, for example, the hinge parts 25 and 27–28 in combination form a hinge socket of generally cylindrical form covering an arc of somewhat greater than 180 degrees, for example, an arc of 200–215 degrees or so. Preferably, buttress walls 29 extend away from the back side of the upper hinge part 25 and its supporting transverse wall 26 to strengthen the hinge structure.

In the illustrated and preferred form of the invention, an impact-resisting spring element 13, which can be molded or extruded, is provided at one end, and preferably at both ends, with a cylindrically contoured end bead 30. The width of the spring element 13 substantially equals the space between the side walls 14, 15 of the clip body, and the diameter of the cylindrical bead 30 substantially equals that of the cylindrical contour formed by the combined hinge parts 25 and 27–28. In as much as the restricted opening defined by the hinge parts is less than the diameter of the hinge socket and also less than the diameter of the cylindrical bead 30, assembly of the impact-resisting spring element 13 requires the bead 30 to be forced laterally into the hinge socket, with a snap-in action. Once installed, the spring element 13 is locked in place, with limited but adequate rotational freedom.

In the preferred embodiment of the invention, the impact-resisting spring element 13 has somewhat of a V-shaped cross sectional configuration with an apex 31 in the center portion thereof. Preferably, the spring element is symmetrically contoured, as reflected in the drawings, such that it need not be oriented end for end to be installed in the clip body. Either end bead 30 or 30*a* can be inserted into the hinge socket formed by the hinge parts 25 and 27–28.

At the end of the clip body opposite the hinge socket is a flat support surface 32, which extends from side wall to side wall of the clip body and preferably has its bottom face located substantially in the plane defined by bottom edges of the side walls 14, 15, so as to lie flat against the surface of the wall 10, as reflected in FIG. 4. The location of the panel 32 is such that, when the spring element 13 is installed in the hinge socket, the upper end cylindrical bead 30*a* rests on the top surface of the panel 32 and is arranged to slide thereon in response to deflection of the spring element. In a preferred embodiment of the invention, abutment stops 34 are formed adjacent the back (upper in FIG. 2) edge of the panel 32 in a position to limit the sliding movement of the upper bead 30*a* of the spring, in response to inwardly directed impact forces thereon.

With reference to FIG. 4, the configuration of the cover shell 8 and impact-resisting spring 13 are such that, with the cover shell installed, but no forces acting thereon, the center portion 31 of the spring element is close to or even lightly touching the inner surface of the cover shell, with the spring 13 in an unstressed condition. When an impact force is applied to the cover shell, tending to displace the center portion thereof inwardly, the spring 13 will resist such displacement with progressively increasing force, as the spring tends to flatten. When the impact force reaches a first limit condition, the upper cylindrical bead 30*a*, sliding upward on the supporting panel 32, engages the abutment stops 34, preventing any further upward movement. During this initial impact-resisting phase, the spring element primarily tends to assume a flatter configuration. Once the limit condition is reached, by contact between the upper bead 32*a* and the abutments 34, further displacement of the center of the spring 13 requires the shape of the spring to be further distorted, increasing the level of impact-resisting forces. Additionally, in the embodiment illustrated in FIGS. 1–4, a central rib 35 is formed in the molded body member 11, extending from one side wall to the other and projecting outward somewhat beyond the outer edges of the side walls 14, 15. In a case of extreme impact, the center portion of the spring element 13 can "bottom" against the outer surface of the rib 35. In this respect, it will be understood that the spring element 13 has considerable spring strength. For example, in a system for mounting a cover shell of approximately eight inches in width, the spring element may be about three inches from end to end, with a thickness of about ⅛th of an inch and width of about 1¼ inches, formed of a relatively strong material, such as polypropylene Because the clip body 11 is an injection molded part, rather than a cut-off section of an extrusion, it is possible to form outwardly projecting triangular alignment tabs 36, 37 on opposite sides of the clip body. Thus, for expeditious and highly accurate mounting of the clip bodies on a wall surface, a chalk line 38 may be applied to the wall at a desired height level, and the individual clip bodies mounted on the wall surface with the pointed alignment tabs located precisely on the chalk line. To further facilitate installation, the opposite end portions of the clip body are formed with vertically elongated openings 39, 40 (FIG. 6) for the reception of fastening screws 41, 42. With this arrangement, after the screw holes are formed in the wall 10, the clip body may be attached to the wall snugly but still movably, then positioned precisely by alignment of the tabs 36, 37 with the chalk line 38, before being fixed permanently in place.

To best advantage, the alignment tabs 36, 37 are located exactly midway between the ends of the clip body 12, such that the clip body may be installed in either end-for-end orientation, without affecting the desired alignment.

After installation of a cover shell 8, its ends would be open and unsightly, except for the placement of end caps 9 and corner caps 10. The end caps and corner caps are conventional elements, well known and widely used in the installation of wall guards of the general type shown herein. For cosmetic purposes, the end wall 45 of an end cap or corner cap tightly abuts the end edges of the installed cover shell 8, either rounding its contours into the wall surface, in the case of an end cap 9, or continuing the contours around an external corner, in the case of a corner cap 10, as shown at opposite ends of the installation in FIG. 1. For cosmetic purposes, the mounting means for the end caps and corner caps is in the form of tabs 46, 47 that extend inside of the cover shell when the latter is installed. Accordingly, it is necessary to position and install the end caps and corner caps prior to mounting of the cover shell.

Figure 6:
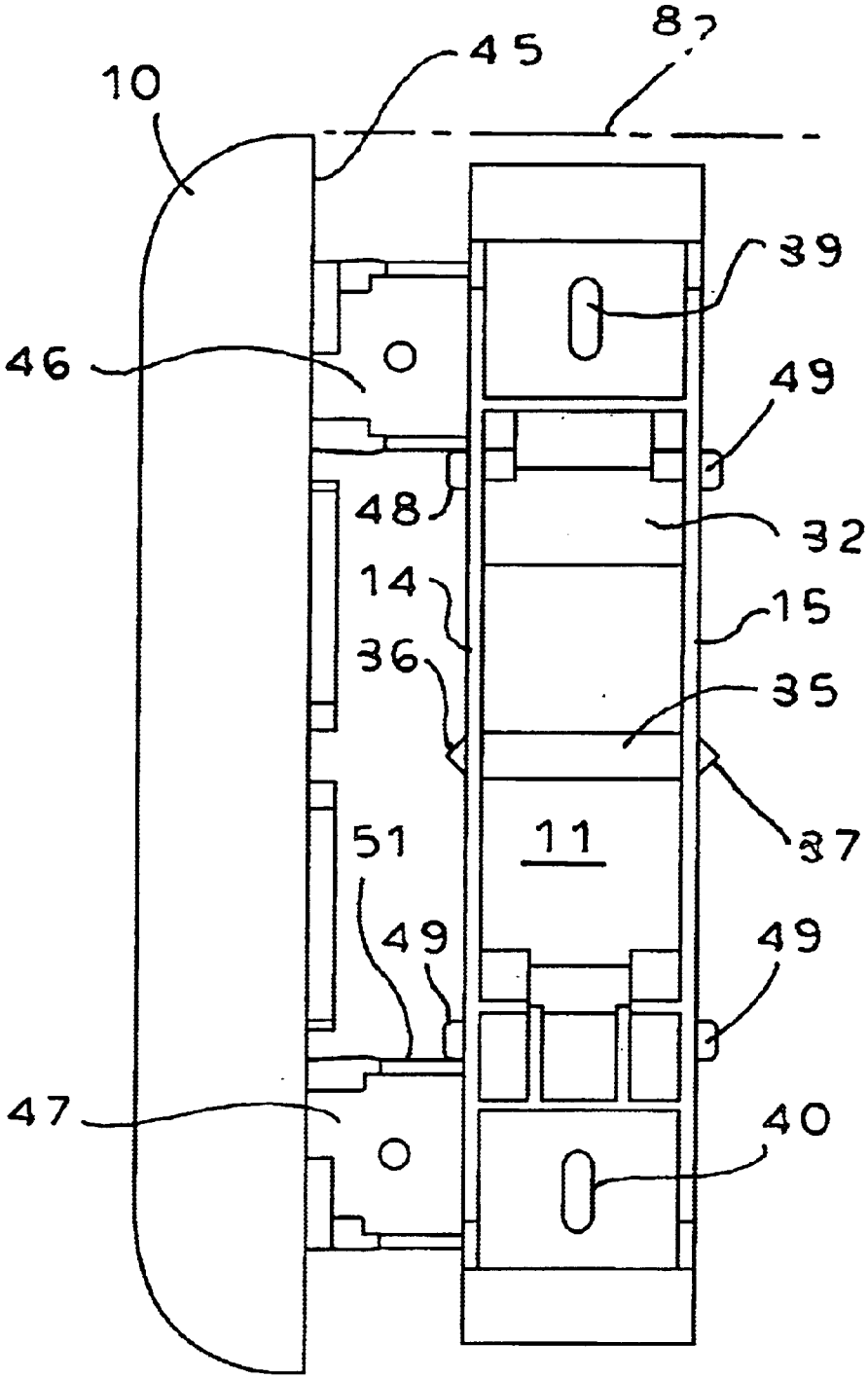
FIG. 6 is a front elevational view of a clip body and end cap, illustrating use of locating tabs on the clip body for accurate positioning and alignment of end caps.

Pursuant to certain aspects of the present invention, the alignment and positioning of end and corner caps is facilitated by the provision of integrally molded locating tabs 48, 49, projecting from opposite sides of each clip body. When positioning the endmost clip element, its outwardly facing side wall 14 (or 15, as the case may be) is positioned a measured distance away from the desired location of the end edge of the cover shell 8. After mounting of the clip 11, an end or corner cap is positioned with its mounting tabs 46, 47 pressed against the side walls of the clip, and with the inner edges 50, 51 of those mounting tabs engaging outer edges of upper and lower locating tabs projecting from the side wall 14, as shown in FIG. 6. This positively and accurately locates the end cap or corner cap in relation to the clip element 11, and enables the end cap or corner cap to be fastened in place in a precisely aligned position, providing a neat, clean smooth surface appearance in the completed installation.

Figure 7:
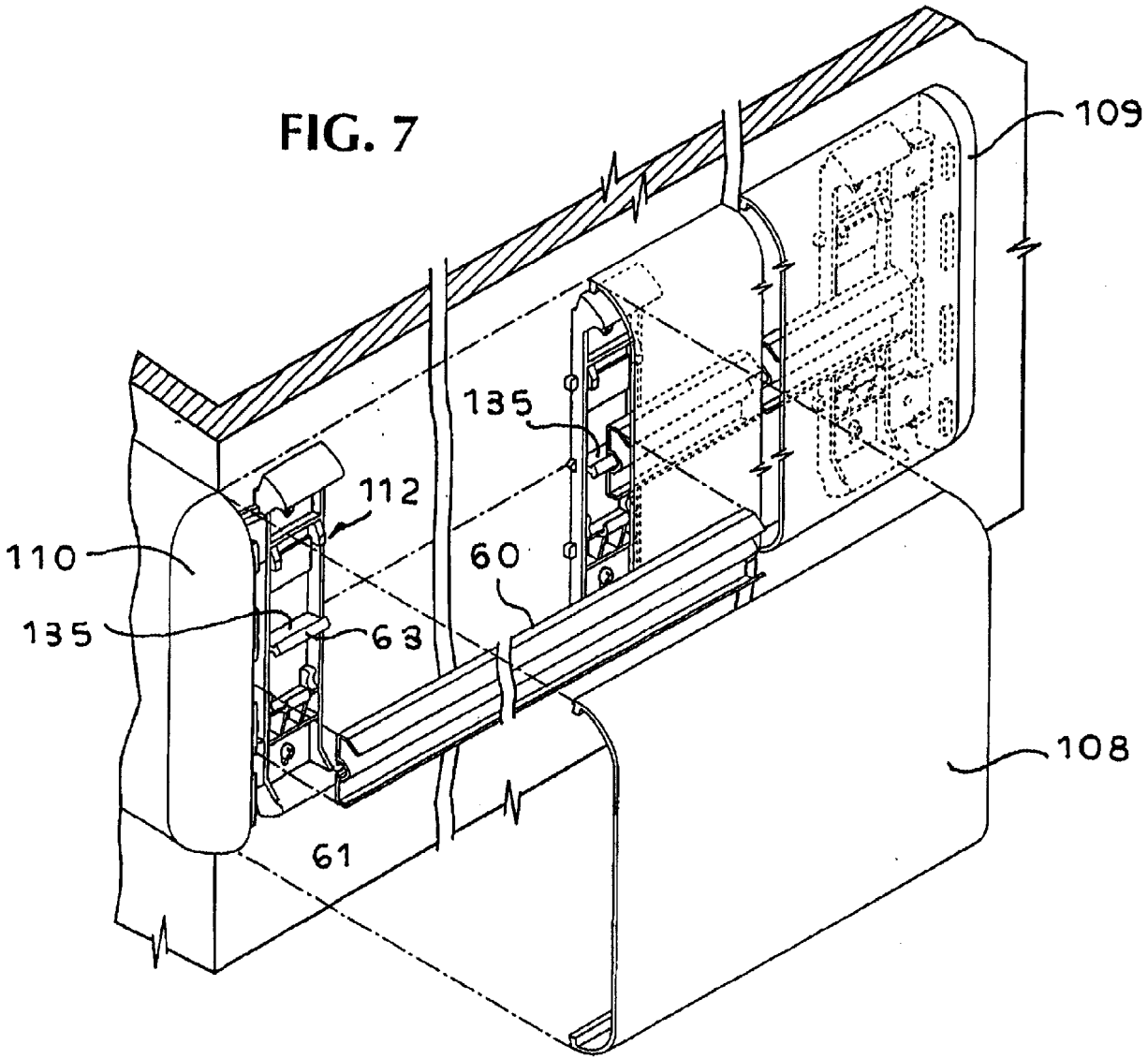
FIG. 7 is an exploded, perspective view of the modified form of wall guard installation, utilizing the clip structure shown in FIG. 5.

For certain installations, because of the nature of the duty requirements and/or preferences of the customer, it may be desired to utilize a resilient cushion element underneath the cover shell, in place of the individual impact-resisting spring elements 13 shown in the embodiment of FIGS. 1–4. This is easily and efficiently accommodated in the device of the present invention, in the embodiment thereof shown in FIGS. 5 and 7. In the structure shown in FIGS. 5 and 7, the impact-resisting spring elements are omitted (or removed) and a continuous, extruded cushioning strip 60 is interposed between the clip bodies 112 and the cover shell 108. The clip bodies 112 and the cover shell 108 are in all respects the same as described in connection with FIGS. 1–4, except for the absence of the spring element 13.

Figure 5:
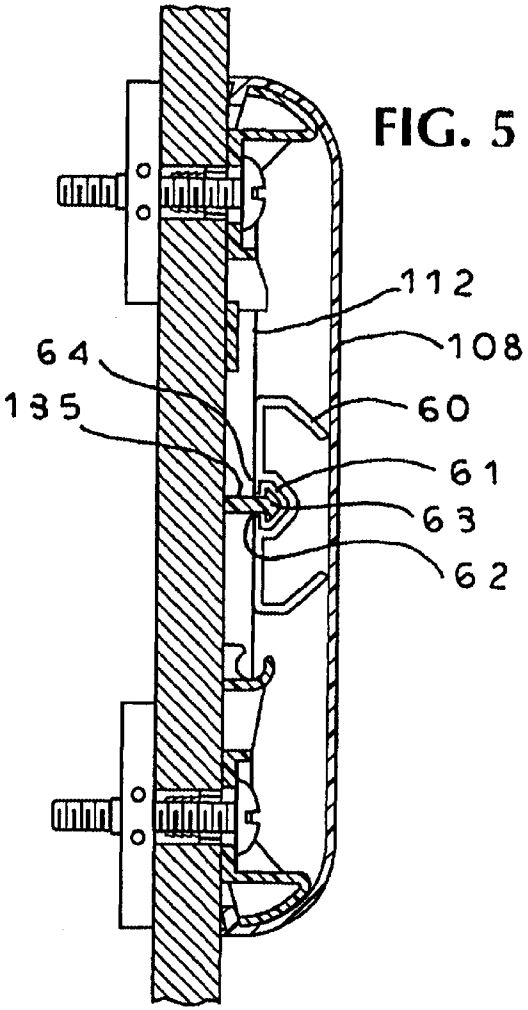
FIG. 5 is a cross sectional view similar to FIG. 4, illustrating an alternative form of cushioning arrangement.

As reflected in FIG. 5, the resilient cushion 60 is formed with a recess 61 along its bottom configured to have a restricted opening 62 defined by flanges 64. The transverse rib element 135, which forms an integral part of the clip body 112, is formed with a somewhat enlarged outer edge portion 63 of generally triangular configuration. The base flanges of the outer edge portion 63 are wider than the restricted opening 62 of the recess 61, as seen in FIG. 5. The cushioning element 60 may be applied over the rib 135 by pressing inwardly, until the resilient flanges 64, defining the restricted opening 62, snap over the enlarged outer edge 63. The resilient element 60 is thereafter loosely retained in position by the ribs 135 of the several clip bodies.

Preferably, the resilient cushioning element 60 is of the same length as the cover shell 108. However, it would be possible to install the cushioning element in more than one section underneath a continuous cover shell by joining adjacent ends of two sections of the cushioning element on a common mounting rib 135.

The resilient cushioning element 60 is advantageously formed of a relatively rigid plastic material, such as PVC and thus does not sag in the unsupported space between adjacent, spaced-apart clip bodies.

In any of its forms, the wall guard system of the invention provides for economical and efficient installation, facilitating accurate alignment and positioning of the individual clip bodies, and also assuring accurate positioning in mounting of end caps and corner caps. This assures a neat, clean-looking installation with minimum labor requirements.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. In a wall guard comprising a plurality of horizontally spaced apart mounting clips fixed to a wall structure and a generally continuous, horizontally disposed plastic cover shell having upper and lower edges engaging and being secured by top and bottom end portions of said clips, an improvement characterized by each of the clips having:

(a) a clip body and, (b) a resilient impact resisting element mounted on said clip body in a space between said clip body and an inner surface of said cover shell; wherein (c) said resilient impact resisting element has upper and lower ends and is anchored at one of said ends to said clip body and slidably engages a surface of said clip body at the other of said ends, and wherein (d) a portion of said resilient impact resisting element between said upper and lower ends extend toward said cover shell inner surface and is positioned to be engaged and displaced by said cover shell when said cover shell is displaced inwardly by an excessive external force.

2. The wall guard according to claim 1, wherein (a) said resilient impact resisting element is formed at said one end with a rounded hinge portion, and (b) said clip body is formed with a hinge socket for reception of said rounded hinge portion.

3. The wall guard according to claim 2, wherein (a) said clip body is formed with an outwardly facing, generally flat surface spaced from said hinge socket and positioned to slideably support said other end of said resilient impact resisting element.

4. The wall guard according to claim 3, wherein (a) said clip body is formed with an abutment stop projecting outwardly from said generally flat surface and forming a limit stop for sliding movement of said other end of said resilient impact resisting element.

5. The wall guard according to claim 1, wherein (a) said clip body is of molded plastic construction and is adapted to be mounted in a vertically orientation, and (b) a molded-in alignment feature is provided on said clip body between said top and bottom end portions of said clip body.

6. The wall guard according to claim 5, wherein (a) said alignment feature comprises pointed indicator tabs projecting laterally from opposite sides of said clip body to facilitate alignment of said clip body with a reference line on said wall structure.

7. The wall guard according to claim 6, wherein (a) said indicator tabs are located centrally between said top and bottom end portions of said clip body, whereby said clip body may be aligned by means of said indicator tabs regardless of the end-for-end orientation of said clip body.

8. The wall guard according to claim 1, wherein (a) at least one of said clip bodies is positioned closely adjacent an open end of said cover shell, (b) said wall guard includes an end cap positioned at and closing off said open end of said cover shell, (c) said end cap has mounting tabs projecting into said open end and secured to said wall structure, and (d) said clip bodies are formed with locating tabs extending laterally from side edges thereof and adapted to interfit with mounting tabs of said end cap positioned adjacent thereto, to facilitate accurate positioning of said end cap with respect to said clip body.

9. The wall guard according to claim 8, wherein (a) said end cap has upper and lower ends and a pair of spaced apart mounting tabs, one adjacent each of its ends, and (b) said locating tabs closely laterally overlap with said mounting tabs to locate said end cap vertically with respect to said clip body.

* * * * *